US008926284B2

(12) United States Patent
Dimelow et al.

(10) Patent No.: US 8,926,284 B2
(45) Date of Patent: Jan. 6, 2015

(54) ASSEMBLY PROVIDING CONTAMINANT REMOVAL

(75) Inventors: Stephen J. Dimelow, Uttoxeter (GB); Ian C. D. Care, Derby (GB)

(73) Assignee: Rolls-Royce PLC, London (GB)

( * ) Notice: Subject to any disclaimer, the term of this patent is extended or adjusted under 35 U.S.C. 154(b) by 633 days.

(21) Appl. No.: 12/822,387

(22) Filed: Jun. 24, 2010

(65) Prior Publication Data

US 2011/0000183 A1 Jan. 6, 2011

(30) Foreign Application Priority Data

Jul. 2, 2009 (GB) ..... 0911459.6

(51) Int. Cl.
*F02C 7/052* (2006.01)
*F01D 5/30* (2006.01)

(52) U.S. Cl.
CPC ..... *F01D 5/3092* (2013.01)
USPC ..... 416/219 R; 415/118

(58) Field of Classification Search
USPC ..... 415/118; 416/61, 215, 219 R, 220 R, 157
See application file for complete search history.

(56) References Cited

U.S. PATENT DOCUMENTS 3,809,495 A * 5/1974 Stahl ..... 416/135
4,718,823 A * 1/1988 Dennison ..... 416/162
4,768,924 A * 9/1988 Carrier et al. ..... 415/189
4,980,241 A * 12/1990 Hoffmueller et al. ..... 428/607
5,062,768 A * 11/1991 Marriage ..... 416/97 R
5,439,347 A 8/1995 Brandon
5,492,445 A * 2/1996 Shaffer et al. ..... 415/136
6,116,608 A 9/2000 Wolfe et al.
6,139,019 A 10/2000 Dinc et al.
6,164,656 A * 12/2000 Frost ..... 277/312
6,902,371 B2 * 6/2005 Anderson et al. ..... 415/115
7,171,936 B2 * 2/2007 Rein et al. ..... 123/193.4
7,306,434 B2 * 12/2007 Goldfinch ..... 416/219 R
7,744,351 B2 * 6/2010 Jabado et al. ..... 416/241 R
2009/0047124 A1 2/2009 Glahn et al.

FOREIGN PATENT DOCUMENTS

JP 63-173801 * 7/1988 ..... 416/219 R

OTHER PUBLICATIONS

United Kingdom Search Report dated Oct. 15, 2009 in United Kingdom Patent Application No. 0911459.6.

* cited by examiner

*Primary Examiner* — Nathaniel Wiehe
*Assistant Examiner* — Woody A Lee, Jr.
(74) *Attorney, Agent, or Firm* — Oliff PLC

(57) ABSTRACT

An assembly for the removal of contaminants from a contact zone between respective contact surfaces 6, 8 of a first component 2 and a second component 4. At least one of the contact surfaces has a low friction element 10 provided with grooves 12 which extend through the contact zone such that, in operation, a pressure difference across the contact zone causes contaminants entering the grooves 12 to be expelled along the grooves 12 from the contact zone.

14 Claims, 4 Drawing Sheets

ASSEMBLY PROVIDING CONTAMINANT REMOVAL

This invention relates to an assembly comprising first and second components, with provision of contaminant removal from a contact zone between the components. The invention is concerned with such an assembly in a gas turbine engine.

Air flowing through a gas turbine engine contains small particles of debris such as soot, dust, sand and grit. These particles are small enough to penetrate contacting regions between components of the engine located in, or forming part of, the flow passages of the engine. When these components are in contact with each other, small movements, particularly repeated reciprocating movements, of one of the components with respect to the other allow the particles to move across the contacting regions.

Such movements can also cause fretting, particularly where the contacting region between the components is under heavy stress. Fretting results in erosion of the contact surfaces and therefore creates debris particles between the respective contacting surfaces of the components.

Particles of debris generated by fretting and particles entrained in the flow through the engine are often abrasive and so increase the rate of wear of the respective contact surfaces of the components. This increase in the rate of wear shortens the useful life of a component.

An example is the dovetail attachment in a gas turbine engine used to attach fan, compressor or turbine blades to their respective discs. Each dovetail attachment comprises a slot into which the root of a blade can be inserted. Each blade has flanks provided on the root. During engine operation, the walls of the dovetail slots act on the blade flanks to resist the centrifugal forces generated by each blade. Cracking of the contacting surfaces can occur, leading to failure of the attachment; if not detected early enough, this may eventually result in the shedding of the blade.

Factors which contribute to cracking include high coefficients of friction at the contact surfaces, high contact stresses, high frequency blade excitation and fretting due to movement of the contact surfaces of the dovetail attachment.

A dry film lubricant is commonly applied to the contact surfaces of the dovetail attachment, principally to reduce fretting but also to reduce the coefficient of friction at the contact surfaces. Dry film lubricants have a tendency to degrade relatively quickly in gas turbine engine applications due to heavy loading and wear and have to be replaced on a periodic basis before substantive damage occurs.

Small particles from the surrounding flow which penetrate the contact region between the flanks of the blade root and the walls of the slot, as well as particles generated as a result of fretting, can migrate into and through the contact region between the flanks and the slot walls as a result of the relative movement between the parts. The relative movement causes the particles to break up, and to abrade the disc and scratch the low friction strip. The process forms an abrasive paste which is forced out of the contact area.

On lower temperature components, a (replaceable) strip containing a low friction wear coating can also be applied to the contact zone to reduce the coefficient of friction at the contact surfaces. Air blown debris can become embedded in these strips making them abrade more like sandpaper rather than acting like a low friction slider.

Another example is that of a unison ring of a gas turbine engine which is used to control the rotational angle of guide vanes located within an annular flow passage of the engine. The unison ring is supported by guide pads that allow the ring to be rotated about its axis, which is coaxial with the engine axis, to increase and decrease the inclination angle of the vanes. The unison ring thus has a reciprocating action about its axis of rotation. Particles caught between the guide pads and the unison ring increase wear of the contacting surfaces of the pads and the ring.

According to the present invention there is provided an assembly of a gas turbine engine comprising first and second components of the gas turbine engine having respective contact surfaces which contact each other over a contact zone. The first and second components are moveable relative to each other at their respective contact surfaces. The contact zone has a first edge and a second edge. A groove is formed in at least one of the contact surfaces, the groove extending entirely across the contact zone from the first edge to the second edge to form an opening between the contact surfaces at one or both of the first and second edges such that, in operation, a pressure difference across the contact zone causes contaminants entering the groove to be expelled along the groove from the contact zone, the first and second components remaining substantially undeformed at their contact surfaces during use.

The groove may be one of a plurality of grooves in the respective contact surface in which case the grooves may be inclined to one another. The grooves may intersect one another.

The groove, or at least one of the grooves, may have a side wall which is inclined to the depth direction of the groove. The groove may have a 'V' or 'U' shaped cross section and may have straight or curved walls. The edges of the groove may also be curved or angled and one edge or side of each groove may differ from the other. In particular, the edges of the groove may be shaped in such a manner as to assist removal of contaminants from a contact surface, for example by a "squeegee" effect.

At least one of the components may comprise a substrate provided with a low friction element providing the contact surface and having the groove.

The low friction element may be made from a polyimide material.

The low friction element may be provided with a wear indicator layer in which the groove, or at least one of the grooves, may extend from the contact surface to the wear indicator layer. The low friction element may have a single wear indicator layer, or the wear indicator layer may be one of a plurality of separate layers at different depths below the contact surface. The colour of each layer may differ from that of the other layers, so that the exposure of one of the layers indicates the severity of wear. A graduated indicator layer comprising diffused colour may also be used.

The substrate may comprise a composite material. The low friction element may be integral with the substrate or may be cast into a composite substrate during manufacture.

The low friction element may contact a metallic surface of the other component.

One of the components may be an aerofoil component having a root portion accommodated in a slot of the other component, the contact surfaces comprising a surface of the root portion and a surface bounding the slot. The aerofoil component may be provided with a low friction element in the form of a strip provided on the root portion, the strip extending in the lengthwise direction of the slot.

One of the components may be a unison ring of a gas turbine engine and the other component may be a support structure for the unison ring. The support structure may be provided with a low friction element in the form of a pad provided on the support structure. The pad may be one of a plurality of pads distributed around the support structure. The pad may be in the form of a strip covering a substantial part of the support structure contact zone.

The pad may be larger than the contact zone, the same size as the contact zone or smaller than the contact zone.

For a better understanding of the present invention, and to show more clearly how it may be carried into effect, reference will now be made, by way of example, to the accompanying drawings, in which.

Figure 4:
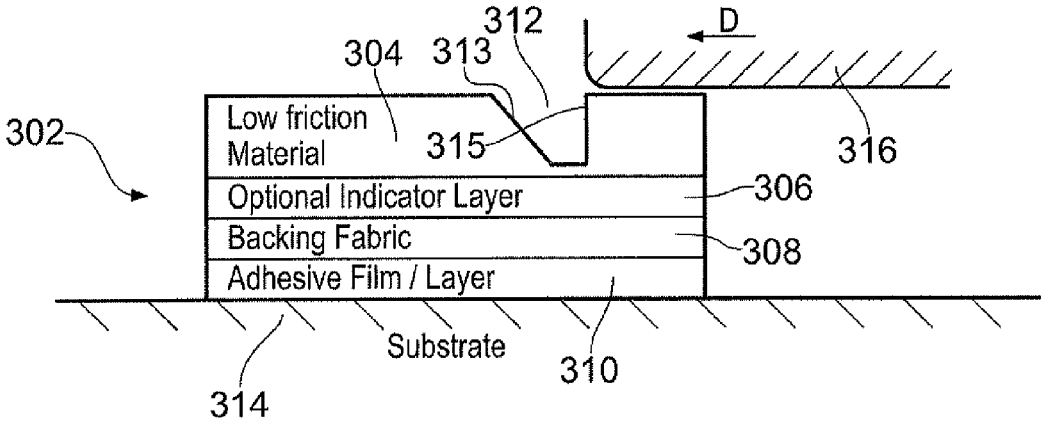
FIG. 4 is a sectional view of a variant of the low friction component.
Figure 5:
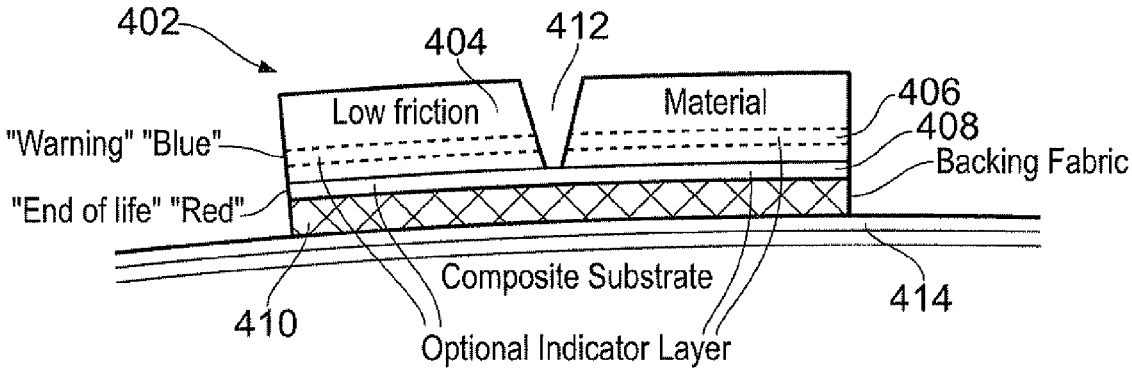
Figure 6:
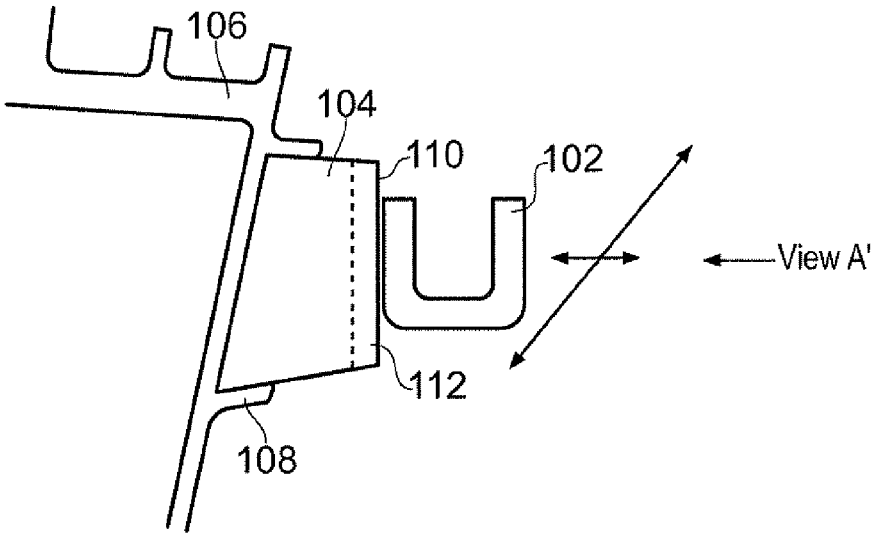
Figure 7:
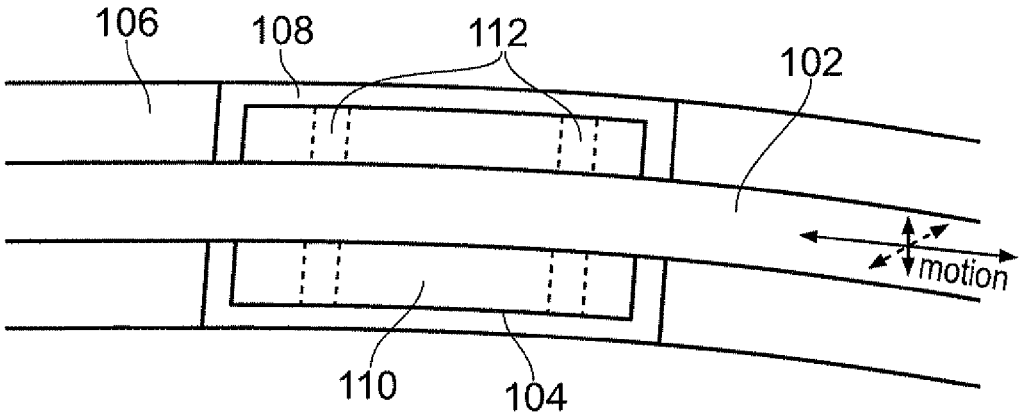
Figure 8:
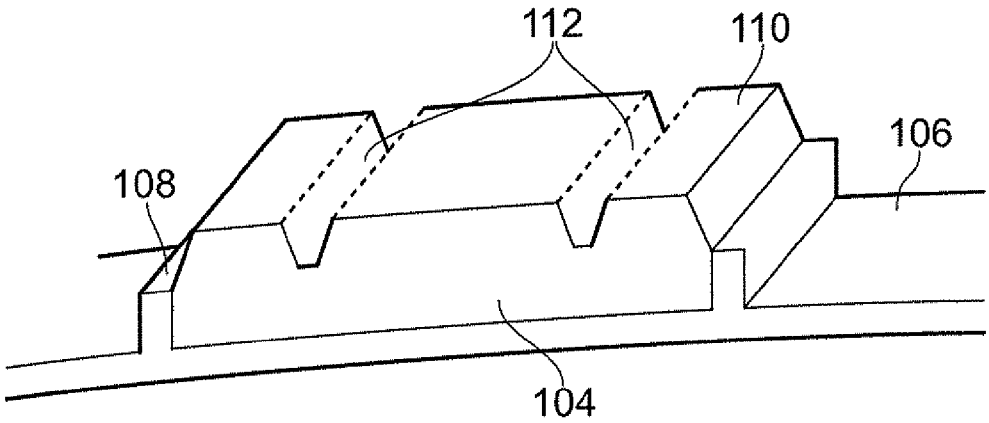

FIG. 5 corresponds to FIG. 4 but shows an alternative embodiment;

FIG. 6 is a sectional view of a unison ring and guide pad assembly;

FIG. 7 is a radially inward view of the unison ring and guide pad assembly of FIG. 6, in the direction of the arrow A' in FIG. 6; and FIG. 8 is a perspective view of a guide pad assembly.

Figure 1:
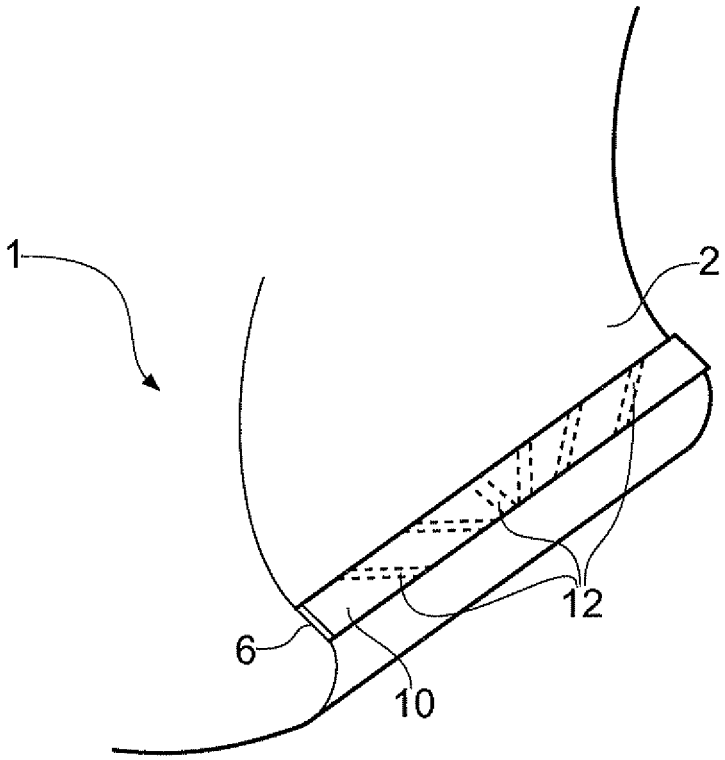
FIG. 1 is a representation of part of a fan blade root.

FIG. 1 shows part of a blade root 2 of a fan blade 1 for a gas turbine engine having a root flank 6 which is provided along its length with a low friction element in the form of a strip 10. The low friction strip 10 has a plurality of grooves 12 on its upper surface which extend across its width. The grooves 12 are at varying angles with respect to the width of the strip 10. In the embodiment shown, the grooves 12 furthest from the ends of the strip 10 extend substantially perpendicularly across the strip, while the grooves 12 nearer the ends of the strip 10 are more inclined to the perpendicular direction, being inclined towards the axial ends of the root 2 in the radially outwards direction.

Figure 2:
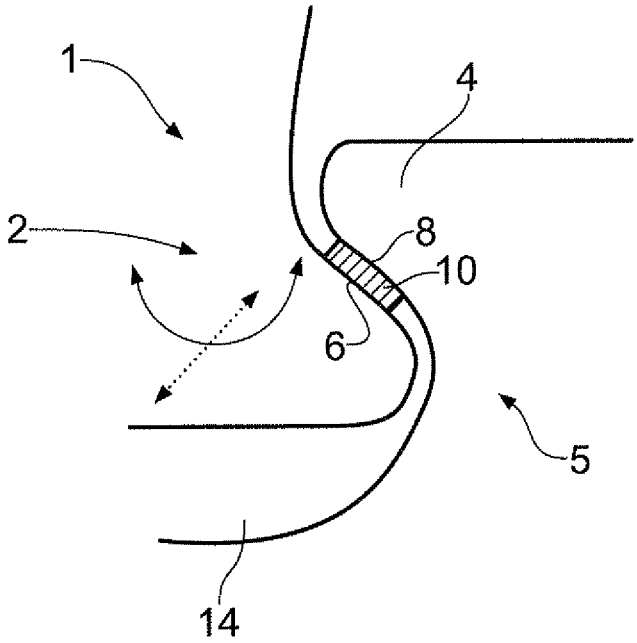
FIG. 2 is a sectional view of the fan blade root shown in FIG. 1 located in a slot.

FIG. 2 shows part of the blade root 2 shown in FIG. 1 located in a slot 4. The slot 4 is one of a plurality of slots provided circumferentially about the radially outer edge of a supporting disk 5 (shown in part). In this embodiment, the slot 4 is a dovetail slot having a slot wall 8 inclined to the radial direction of the disk 5. The inclination of the slot wall 8 corresponds to the inclination of the root flank 6 so that the low friction strip 10 is sandwiched between the slot wall 8 and the root flank 6. The region of contact between the low friction strip 10 and the slot wall 8 is the contact zone. A cavity 14 is provided beneath the blade root 2 in the slot 4, in which in use a blade chocking mechanism (not shown) holds the blade in a radially outward position.

A low friction strip 10 may be provided on one side or on both sides of the blade root 2.

When the engine is running, rotation of the disk 5 creates a centrifugal outwards force on any particles in the contact zone. However, this may not be sufficient to drive them from the contact zone. As the blades 1 of the engine rotate, a pressure difference is created across the blades 1 in the axial direction of the engine. There is thus a pressure difference across the chord of each blade 1. This pressure difference can be used to create an air flow between the main flow path through the engine and the cavity 14. It can be arranged that part of this air flow is through the grooves 12. This air flow can then assist in the removal of particles and debris.

In some embodiments for example if the blade 1 is a turbine blade operating in the flow of hot combustion gases, cooling air may be supplied to the cavity 14. The difference in pressure between the cooling air and the flow along the main flow path creates a pressure differential between the respective ends of the grooves 12 causing cooling air to flow through the grooves 12 from the cavity 14 into the main flow.

In some embodiments the grooves 12 may be shaped and extend into either the main flow path or the cavity 14. Such grooves will act as scoops as the blades 1 and disk 5 rotate, thereby generating a pressure drop to drive air flow through the grooves.

Alternatively or additionally, the groove 12 may diverge along its length to create a pressure drop between one end of the groove and the other. Such a pressure drop would also drive air flow through the groove.

Rotation of the fan blade 1 about the engine axis causes a centrifugal force to act on the fan blade 1 and the blade root 2. The centrifugal force holds the low friction strip 10 in contact with the slot wall 8 at a very high contact pressure. Various factors in operation of the engine, such as high cycle blade excitations, cause the blade root 2 to move within the slot 4. The movement of the blade root 2 with respect to the slot 4 may be a rocking movement or small oscillatory displacements.

Any particles reaching the contact zone between the low friction strip 10 and the slot wall 8, or particles created in the contact zone by movement of the blade 1 in the slot 4, migrate across the contact zone under the action of the relative movement between the low friction strip 10 and the slot wall 4, the particles eventually reaching the edge of the strip 10 or one of the grooves 12.

Particles entering the grooves 12 are carried by air flow along the grooves 12 and are expelled from the contact zone through the respective low pressure ends of the grooves 12. Removal of the particles from the contact zone reduces the amount of wear of the low friction strip 10 and the slot walls 8.

The alignment of at least some of the grooves 12 may be biased in the direction of particle migration. The grooves 12 may be provided in areas of the contact zone under lower contact stress.

Figure 3:
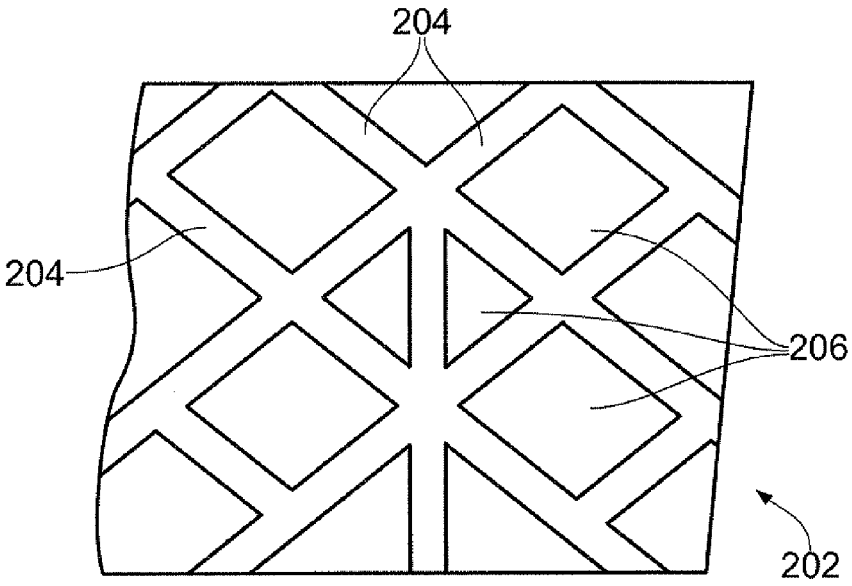
FIG. 3 shows part of a low friction component.

An alternative embodiment of a low friction strip 202 is shown in FIG. 3. The low friction strip 202 is provided with a plurality of grooves 204 which intersect to form a lattice arrangement. The low friction strip 202 is thus segmented into a series of pedestals 206 between which the grooves 204 extend. The pedestals provide sufficient surface area to support the components (such as the blade root 2 and the slot wall 8) with respect to each other. In the embodiment shown in FIG. 3, each groove 204 extends parallel to or at an angle of approximately 45 degrees to the width of the strip 20, although other angular relationships are possible. The grooves 204 form pathways from one edge of the strip 202 (for example the lower edge in FIG. 3) to the opposite edge (for example the upper edge). At least some of the grooves 204 extend only part of the way across the strip 202, opening at one or both ends at another of the grooves 204. At least some of the grooves 204 open at one or both ends at an edge of the strip 202.

During operation of the engine, particles entering the grooves 204 are carried by the flow along the grooves 204 and are expelled from the sides of the low friction strip 202.

FIG. 4 shows a low friction strip 302 mounted on a substrate 314 of a first component for contact with a second component 316. The low friction strip 302 comprises a top layer 304, a coloured indicator layer 306, a backing layer 308 and an adhesive layer 310. The top layer 304 is provided with a groove 312 for the removal of particles of debris as discussed above. The groove 312 has sides 313, 315 of different angles of inclination. Consequently, particles are preferentially trapped in the groove 312 during movement in one direction D between the first and second components 314, 316, compared with movement in the other direction. In this embodiment the top layer 304 is manufactured from a low friction material. The indicator layer 306 is provided below the top layer 304 and is secured to the backing layer 308 which is further secured to a substrate 314 by an adhesive layer 310 such as an adhesive film.

During operation, as the top layer 304 becomes worn the depth of the groove 312 decreases. Once the top layer 304 has been worn away the indicator layer 306 becomes visible. Where the top layer 304 has been worn away in the vicinity of the groove 312, the groove 312 no longer exists thereby reducing the effectiveness of particle removal from the contact zone. The appearance of the indicator layer 306 indicates that the low friction strip 302 needs to be replaced.

FIG. 5 shows another embodiment in which a low friction strip 402 is attached to a composite substrate 414. The substrate 414 may be on the annulus line where a blade contacts an annulus filler piece in a gas turbine engine. The strip 402 comprises a top layer 404, a first indicator layer 406 below the top layer 404 and a second indicator layer 408 below the first indicator layer 406. The top layer 404 may be manufactured from an appropriate low friction material. A groove 412 is provided in the top layer 404 and extends into the first indicator layer 406, but not the second indicator layer 408. The groove 412 is 'V' shaped and so the first indicator layer 406 is visible when the groove 412 is viewed from above. A backing layer 410 is provided below the second indicator layer 408. The backing layer 410 may be bonded to the composite substrate 414 by resin infusion or thereto-plastic bonding.

As the top layer 404 becomes worn, the depth and width of the groove 412 decreases. The part of the first indicator layer 406 which is visible in the groove 412, allows the amount of wear to be determined. Once the top layer 404 has worn away the remainder of the first indicator layer 406 becomes visible. At this point, because the groove 412 is V-shaped, its width and depth have been significantly reduced, thereby reducing the amount of flow along the groove 412. As an alternative, the groove 412 may be U-shaped with substantially parallel sides to maintain groove width, and therefore flow, for longer. The first indicator layer 406 thus provides indication that the low friction strip 402 is nearing the end of its operational life. Continued wear results in the first indicator layer 406 being worn away so that the second indicator layer 408 becomes visible. At this point the groove 412 no longer exists and particle removal from the contact zone is reduced. The appearance of the second indicator layer 408 thus indicates that the low friction strip 402 needs to be replaced.

In the embodiments of FIGS. 4 and 5, the wear indicator layers 306, 406, 408 may be made from a low friction material, for example the same material as the respective layers 304, 404, with the addition of a suitable colouring material.

FIG. 6 shows an alternative embodiment of the invention in which a unison ring 102 for a gas turbine engine is supported by a guide pad 104 mounted on a support structure in the form of an engine casing 106. The unison ring is centred on the engine axis and is rotatable to cause common displacement of an array of components such as variable inlet guide vanes.

The guide pad 104 is located with respect to the engine casing 106 in a recess defined by a surrounding wall 108. The guide pad 104 is one of a plurality of guide pads which are distributed around the axis of the engine. The guide pad 104 is in contact with a radial end face of the unison ring 102 to resist radial movement and warping of the unison ring 102 during operation.

The thickness of the guide pad 104 in the axial direction of the engine is greater than the axial thickness of the unison ring 102. Consequently, when viewed in the direction of the arrow A', as shown in FIG. 7, the guide pad 104 extends axially forward and rearward of the unison ring 102. The contact zone is the region of the guide pad 104 in contact with the unison ring 102.

The guide pad 104 is provided with two grooves 112 which extend across the contact surface 110 of the guide pad 104 which is in contact with the unison ring 102. The grooves 112 extend axially forwards and rearwards from the contact zone. The grooves 112 have a substantially V-shaped cross section, as shown in FIG. 8.

During operation of the engine, flow over the guide pad 104 and the unison ring 102 is provided in a generally axial direction with respect to the unison ring axis. This may be flow ducted from the main flow through the engine, cooling flow or flow from outside the engine. This flow generates a pressure difference between the ends of the grooves 112, causing flow to take place through them across the unison ring 102.

Rotation of the unison ring 102 causes the unison ring 102 to rub against the guide pad 104.

The unison ring 102 may also flex or become displaced in an axial or radial direction so that it moves with respect to the guide pad 104. The unison ring 102 may not, therefore, always remain in contact with the guide pad 104 and may instead be intermittently in contact with the guide pad 104. This relative movement of the guide pad 104 with respect to the unison ring 102 causes particles which have penetrated the contact zone to migrate across the contact zone. As the particles move across the contact zone they wear the guide pad 104 and the unison ring 102. The particles continue to move across the contact surface until they enter one of the grooves 112 or move outside the contact zone. Those particles which enter the grooves 112 are entrained in the flow through the grooves 112 and are expelled from the contact zone. Removal of particles from the contact zone reduces wear of the guide pad 104 and the unison ring 102.

The embodiment of FIGS. 6 to 8 may employ guide pads constructed in accordance with the embodiments shown in FIGS. 4 and 5, and with groove configurations as shown in FIGS. 1 and 3.

The embodiment of FIGS. 6 to 8 may be employed on unison or guide rings located circumferentially around a gas turbine engine.

The low friction strip 10, the top layers 304, 404 and wear indicator layers 306, 406, 408 of the low friction strips 302, 402, and the guide pads 104 may be made from any suitable low friction material that can withstand the ambient conditions and contact pressures which prevail in use. Suitable materials comprise polymer materials such as aromatic polyimides capable of withstanding elevated temperatures, for example temperatures in excess of 200° C., and possibly 260° C. A suitable material is that available under the name Vespel®.

It will be appreciated that the present invention is not limited to use with the embodiments described above, but can be used in other applications in which debris enters or is generated within a contact zone between two surfaces.

The invention claimed is:

1. An assembly for a gas turbine engine comprising:

first and second components of the gas turbine engine having respective contact surfaces which contact each other over a contact zone, the first and second components being moveable relative to each other at their respective contact surfaces, the contact zone having a first edge and a second edge; and a groove formed in at least one of the contact surfaces, the groove extending entirely across the contact zone from the first edge to the second edge to form an opening between the contact surfaces at one or both of the first and second edges such that, in operation, a pressure difference across the contact zone causes contaminants entering the groove to be expelled along the groove from the contact zone, the first and second components remaining substantially undeformed at their contact surfaces during use, one of the components being an aerofoil component having a root portion accommodated in a slot of the other component, the contact surfaces comprising a surface of the root portion and a surface bounding the slot.

2. An assembly according to claim 1, wherein the groove is one of a plurality of grooves in the at least one of the contact surfaces.

3. An assembly according to claim 2, wherein the grooves are inclined to one another.

4. An assembly according to claim 3, wherein the grooves intersect one another.

5. An assembly according to claim 1, wherein the groove is one of a plurality of grooves and at least one of the grooves has a side wall which is inclined to the depth direction of the groove.

6. An assembly according to claim 1, wherein the groove is one of a plurality of grooves and at least one of the grooves diverges along its length to create a pressure drop across the assembly.

7. An assembly according to claim 1, wherein at least one of the components comprises a substrate provided with a low friction element providing the contact surface and having the groove.

8. An assembly according to claim 7, wherein the low friction element is provided with a wear indicator layer at a predetermined depth below the contact surface.

9. An assembly according to claim 8, wherein the groove is one of a plurality of grooves and at least one of the grooves extends into the low friction element from the contact surface at least to the depth of the wear indicator layer.

10. An assembly according to claim 8, wherein the low friction element is provided with a plurality of indicator layers at a plurality of predetermined depths below the contact surface.

11. An assembly according to claim 1, wherein at least one of the components comprises a substrate provided with a low friction element providing the contact surface and having the groove, and wherein the low friction element is in the form of a strip provided on the root portion, the strip extending in the lengthwise direction of the slot.

12. An assembly for a gas turbine engine comprising:

first and second components of the gas turbine engine having respective contact surfaces which contact each other over a contact zone, the first and second components being moveable relative to each other at their respective contact surfaces, the contact zone having a first edge and a second edge; and a groove formed in at least one of the contact surfaces, the groove extending entirely across the contact zone from the first edge to the second edge to form an opening between the contact surfaces at one or both of the first and second edges such that, in operation, a pressure difference across the contact zone causes contaminants entering the groove to be expelled along the groove from the contact zone, the first and second components remaining substantially undeformed at their contact surfaces during use, one of the components being a unison ring of a gas turbine engine and the other component being a pad provided on a support structure for the unison ring, the groove being provided in the pad.

13. An assembly according to claim 12, wherein the pad is a low friction element.

14. An assembly according to claim 13, wherein the pad is one of a plurality of pads distributed around the support structure.

* * * * *